US005442129A

United States Patent [19]

Mohrlok et al.

[11] Patent Number: 5,442,129

[45] Date of Patent: * Aug. 15, 1995

[54] METHOD OF AND CONTROL SYSTEM FOR AUTOMATICALLY CORRECTING A PITCH OF A MUSICAL INSTRUMENT

[75] Inventors: Werner Mohrlok, Hohenbergstr. 16, D-7218 Trossingen; Herwig Mohrlok, Trossingen, both of Germany

[73] Assignee: Werner Mohrlock, Trossingen, Germany

[ * ] Notice: The portion of the term of this patent subsequent to Oct. 15, 2009 has been disclaimed.

[21] Appl. No.: 458,725

[22] PCT Filed: Aug. 3, 1988

[86] PCT No.: PCT/EP88/00702

§ 371 Date: Jan. 14, 1993

§ 102(e) Date: Jan. 14, 1993

[87] PCT Pub. No.: WO89/01219

PCT Pub. Date: Feb. 9, 1989

[30] Foreign Application Priority Data

Aug. 4, 1987 [DE] Germany ..... 37 25 820.6

[51] Int. Cl.[6] ..... G10H 7/00; G10H 1/38

[52] U.S. Cl. ..... 84/637; 84/657; 84/669; 84/685; 84/715

[58] Field of Search ..... 84/619, 657, 685, 637, 84/669, 715, DIG. 18

[56] References Cited

U.S. PATENT DOCUMENTS 4,230,012 10/1980 Bommersbach et al. .
4,248,119 2/1981 Yamada .
4,300,430 11/1981 Bione et al. .
4,498,363 2/1985 Shimada et al. .
4,508,002 4/1985 Hall et al. .

*Primary Examiner*—William M. Shoop, Jr.
*Assistant Examiner*—Jeffrey W. Donels
*Attorney, Agent, or Firm*—Anderson Kill Olick & Oshinsky

[57] ABSTRACT

A pitch control system for the automatic pitch correction according to a harmony-dependent tuning, especially the harmonic tuning, for a musical instrument, having an input device for the input of note input signals in a pre-determined fixed tuning, especially the tempered tuning, and having a note generation device to which the note input signals are applicable, comprises a chord recognition circuit which ascertains at each input signal pattern corresponding to a chord whether this input signal pattern corresponds to a chord pattern from a pre-determined quantity of chord patterns, a signal pattern store circuit in which for each chord pattern of the pre-determined quantity of chord patterns a signal pattern is stored, and a control circuit which, when the chord recognition circuit ascertains that an input signal pattern is present corresponding to one of the pre-determined chord patterns, causes the signal pattern store circuit to emit the signal pattern, corresponding to the ascertained chord pattern, to the note generation device, for the production of the chord in each case in the variable tuning.

26 Claims, 5 Drawing Sheets

| | 1) = Hz | 2) = Hz |
|---|---|---|
| | 700 494 Q<br>300 392 M<br>0 330 G | 1200 523 G<br>700 392 Q<br>400 330 T |
| | 702 495 Q<br>316 396 M<br>0 330 G | 1200 523 G<br>702 392 Q<br>386 327 T |
| | 696 493 Q<br>310 394 M<br>-6 329 G | 1204 524 G<br>706 393 Q<br>390 328 T |

| | 1) = Hz | 2) = Hz |
|---|---|---|
| | 700 494 Q<br>300 392 M<br>0 330 G | 1200 523 G<br>700 392 Q<br>400 330 T |
| | 702 495 Q<br>316 396 M<br>0 330 G | 1200 523 G<br>702 392 Q<br>386 327 T |
| | 696 493 Q<br>310 394 M<br>-6 329 G | 1204 524 G<br>706 393 Q<br>390 328 T |

METHOD OF AND CONTROL SYSTEM FOR AUTOMATICALLY CORRECTING A PITCH OF A MUSICAL INSTRUMENT

DESCRIPTION

The invention relates to a method of automatically correcting a pitch in accordance with a harmony-dependent variable tuning, especially harmonic tuning, of a musical instrument having an input device for the input of note input signals in a pre-determined fixed tuning, especially the synchronously vibratingly tempered tuning, and having a note producing device to which the note input signals can be applied, with the following steps:

a) in the case of an input signal pattern corresponding to a chord one ascertains, by comparison with pattern chords of a pre-determined quantity of chord patterns, whether one of these chord patterns is present;

b) in the case of presence of a chord pattern the input signal pattern is replaced by an input signal pattern corrected according to this chord pattern and is applied to the note producing device, while the signal of the signal patterns, allocated to a predetermined fundamental note of the respective chord pattern, is fixed according to the pre-determined fixed tuning and the signals of the signal pattern allocated to the other notes of the chord pattern, starting from the fundamental note, are corrected according to the variable tuning.

A long existing problem of selecting a tuning consists in that when the "harmonically pure tuning", which is preferred in the course of playing of multiharmonic music and which indeed produces pleasant-to-hear chord sounds due to partial overlap of overtones and primary tones of the chord notes, is selected, the transition from one key to the other still requires a corresponding adaptation of the tuning (even within a harmonically tuned key there are chords having a frequency ratio not corresponding to the harmonically pure tuning). In order, in the case of instruments which cannot vary their tuning during playing (for example the keyboard instruments pianoforte or organ), to render possible playing in various keys and the modulation from one key to the other, these instruments are tuned in a pre-determined fixed tuning in which the chords sound more or less equally well (or equally badly) in the keys which come into question. One example for such a fixed tuning is the tempered tuning according to Johann Sebastian Bach. However other fixed tunings have also been proposed, especially the baroque tunings "Werckmeister" and "Kirnberger" (see DE-PS 2,558,716) which prefer specific chords or keys, but at the cost of other chords or keys.

It is known from DE-A 3,304,995 to provide an electronic keyed instrument with tonality selection keys for manual operation during playing, actuation of which has the consequence that the keyed instrument is instantaneously harmonically purely tuned with regard to the selected tonality (for example C major sub-dominant). This manual actuation disturbs the flow of playing and further presumes that the player immediately recognises the tonality in each case during playing.

From DE-A 3,545,986 an electronically controlled musical instrument is known which examines successive notes as to whether they can be allocated to a key. If this is the case, next the instrument is harmonically purely tuned to the corresponding key, for example C major or E minor. For the unequivocal identification of the respective key the seven notes of an octave are needed. Thus under some circumstances the key identification takes place only after relatively long playing, or not at all. If thereafter a piece of music begins anew or a modulation or a shift takes place, the struck chords then do not sound harmonically pure. Even remote-key passing-notes, such as ornamentations or chromatic passages, cause such an instrument temporarily to cause the tonally specified harmonic tuning and to tune harmonically purely to the old tonality or possibly a new tonality only after a waiting time. Likewise such an instrument does not tune to a key, or constantly changes tuning, if multi-part music sounds which cannot be fixed to a major or minor key.

From DE-B 3,023,578 a circuit arrangement for the identification of the chord type and its fundamental note is known which serves to produce an automatic accompaniment to a melodic part played on the instrument. WO-A-80/00110 likewise shows a circuit arrangement for chord recognition with the possibility of causing the whole chord to sound by pressing of the key allocated to a chord fundamental note.

From U.S. Pat. 4,248,119 a method of the initially stated kind is known in which, after identification of the chord in each case, the chord notes are corrected in relation to the chord fundamental note in such a way that harmonically pure chord tuning results. The chord fundamental note is here not corrected, that is it corresponds to the pre-determined fixed (synchronously vibratingly tempered) tuning. With this known method thus harmonically purely tuned chords result. However it has been recognised that different chords played in immediate succession can sound unpleasant, especially when the same notes occur in the two chords, but in different function. By reason of the frequency correction, which in each case is specific to the chord and therefore different, of these notes, in the two chords they lie at different pitches, which is felt unpleasant in the case of correspondingly great frequency difference.

In comparison therewith, the object of the invention consists in providing a method of the initially stated kind with which it is possible to achieve a further sound improvement.

This object is achieved by additionally correcting the signal of the signal patterns allocated to the fundamental note, in relation to the pre-determined fixed tuning, and correcting the signals of the signal pattern, allocated to the other notes of the chord pattern, starting from the corrected fundamental note, according to the variable tuning, correcting the signal allocated to the fundamental note of a chord, in such a way that the correspondingly corrected note delivered by the note producing device lies higher or lower than the fundamental note in the pre-determined fixed tuning, according to whether the chord notes, corrected according to the signal pattern, lie lower or higher on average than the uncorrected chord notes in the fixed tuning.

This measure according to the invention results in a kind of equalisation successive chords, with the consequence that the frequency differences of equal notes are reduced. Successive chords sound noticeably better.

Preferably the signal allocated to the fundamental note of a chord will be corrected in such a way that the displacement of a mean frequency of the chord notes is at least approximately compensated, on the basis of the correction of the chord notes by the signal pattern. In the case of use of correction signals stating relative frequency variations it is proposed that the signal allocated to the fundamental note of a chord is corrected with an additional correction signal stating a relative frequency variation, which signal corresponds in value, but with reversed sign, to the mean value of the correction signals, likewise indicating relative frequency variation, for the input signals.

By this additional correction notes of like name in chords, which can be represented as stages of one single key, are retuned only so far that this retuning lies below the audibility limit. An example would be the note E in D major, as third of the stage I, C-E-G, as fundamental note of stage III, E-G-B or as fifth of stage VI, A-C-E. Thus a key-independent but key-compatible retuning takes place.

Special attention must be accorded, in the case of small major seventh chords, to the note with the function of the small seventh in the chord. In tempered tuning this note has the value of 1000 cents in relation to the fundamental note of the chord. In historic time the small seventh of a scale was often tuned to the value 7/4 in relation to the fundamental note, which corresponds to the frequency ratio of the 7th harmonic of a natural note sequence. However this value is useless for present-day practical music-making, since with 969 cents it is too remote from the value of the tempered tuning.

The frequency ratio as it occurs in the dominant seventh chord within a harmonically tuned major scale offers a usable value. In the dominant seventh chord the fundamental note is formed by the fifth of the relevant key, while the small seventh is formed by the fourth of the octave lying thereabove. The fifth has a frequency ratio of 3/2 relation to the fundamental note of the key, the fourth lying thereabove of the next octave has a ratio of $2\times4/3=8/3$ to the fundamental note of the key. Thus the small seventh of the dominant seventh chord is in the proportion to its fundamental note as $8/3:3/2=16/9$. This corresponds to 997 cents to the chord fundamental note. After execution of the already-mentioned additional correction this note in the small major seventh chord results in a correction of preferably +1 cent to the frequency of the tempered tuning, which sounds well.

In the case of a small minor seventh chord on the other hand the note with the function of the small seventh in the chord has the usual value of 6:5 to the fifth, which corresponds to a spacing of 1018 cents to the fundamental note.

In order to have to effect only a chord pattern comparison in the 12-note space corresponding to one octave, it is proposed that the input signal pattern is projected on to a pre-determined octave (definition octave) and compared with the chord patterns, likewise each limited to one octave, of the pre-determined quantity of chord patterns.

This comparison can be effected, in a first alternative, in that the input signal pattern is displaced as a whole by half-notes within the definition octave, and the displacement steps are counted, until a signal lies at a pre-determined end of the definition octave, and that the signal pattern shifted in this way is compared with the chord patterns of the pre-determined quantity of chord patterns, where among the chord patterns a chord note in each case likewise lies at the pre-determined end of the octave.

It is however also possible to proceed in a manner in which the chord patterns of the pre-determined quantity of chord patterns are shifted by half-notes cyclically within the octave, counting the shift steps, and the chord patterns shifted in this manner are compared each with the unshifted input signal pattern. The first alternative has the advantage that one makes a small number of displacement steps suffice. The second alternative has the advantage that one has only to compare one single chord pattern per chord type, even though with longer calculation time, whereas in the case of the first alternative, for example in the case of a major triad, three chord patterns in all, allocated to this triad, have to be compared with the input signal pattern.

In order, when one of the chord patterns is present, to be able to replace the input signal pattern by a correspondingly corrected input signal pattern, to the chord patterns of the pre-determined quantity of chord patterns there are allocated signal patterns which either can already correspond to the corrected input signals (for example by statement of the note frequency in each case, or which, preferredly, form correction signals for the input signals.

So that the signal patterns allocated to the chord patterns can likewise be limited to one octave it is proposed, for the simple consideration of the initial displacement of the input signal pattern and/or the chord patterns, that in the case of conformity of the input signal pattern within the definition octave with a chord pattern of the pre-determined quantity of chord patterns one charges a signal pattern, allocated to the chord pattern concerned and limited to one octave, into an output store and shifts the signal pattern according to the number of displacement steps by half-notes in the output store in the opposite direction, possibly cyclically. The direction of displacement is thus opposite to the initial displacement of the input signal pattern or the chord patterns. In the case of cyclic displacement of the chord patterns within the octave, that is with feeding of the store content from the overflow end of the store to the other store end, a cyclic displacement in the opposite direction takes place correspondingly in the output store. The correction signals then stand in the corresponding position of the octave, so that now only the input signals, irrespective of in which of the possible octaves they stand, are to be corrected. The correction signals relate preferably to relative frequency variations, especially stated in cents, in order to achieve independence of the octaves.

An especially preferred further development of the method according to the invention is characterised in that after ascertaining an input signal pattern corresponding to a chord pattern, one ascertains among the following input signal patterns whether the corresponding note or notes of the input signal pattern is or are contained completely in the chord pattern and if so one corrects this note or these notes according to the chord pattern. This measure offers the advantage that directly after the playing of a chord from the quantity of the pre-determined patterns, and its sounding in harmonic tuning, individual notes or combinations of individual notes of this chord can also be played, without the tuning of these notes changing. This is very advantageous if for example a chord is played to a choir for intonation, and then the individual notes of this chord are to be played to the choir.

In further development of this measure it is proposed that additional chord notes are allocated to the pattern chords and that on ascertaining an input signal pattern corresponding to a chord pattern among the following input signal patterns one ascertains whether the corresponding note or notes of the input signal pattern correspond to additional chord notes of the ascertained chord pattern, and if so corrects this note or these notes according to the additional chord notes. These chord additional notes are notes which downwardly or upwardly adjoin the pattern chord. Large or small thirds are preferredly provided, where a large third of the pattern chord is adjoined by a small third for the additional chord note, and vice versa. Thus in the case of a major triad an additional chord note adjoins downward at the interval of a small third and an additional chord note adjoins upwards at the interval of a large third.

In the case of a multi-manual input device it is proposed that for each manual separately the respectively associated input signal pattern is compared with the chord patterns of the pre-determined quantity of chord patterns. Since in general accompaniment chords are played on one of the manuals, these can be identified even when chord-foreign notes, for example what are called passing notes, are being played on another manual.

It is further proposed that after ascertainment of an input signal pattern corresponding to a chord pattern, on one of the manuals, the following input signal patterns of all manuals are examined as to whether the corresponding note or notes are completely contained in the chord pattern. Thus the chord-identical notes of all manuals are corrected, while the notes not pertaining to the ascertained chord pattern retain the frequencies of the tempered tuning.

In place of or in addition to the proposed additional correction of the fundamental note frequencies of the chords, to avoid ill-sounding frequency differences of equal notes of successive chords, it is proposed that, in two successive input signal patterns which correspond each totwo successive chord patterns of the pre-determined quantity of chord patterns, one ascertains whether the same note occurs in both chord patterns, and if this is so one effects such an additional ocrrection in the second input signal pattern that the conforming notes in the two chords possess substantially the same level or at least a frequency differencenot exceeding a pre-determined value of preferably less than 8 cents. If this additional correction concerns only the conforming note, then correspondingly there results a slight deviation of this note from the variable tuning in the second chord. It is however also possible to let this additional correction pertain to all notes of the new chord, so that a shift of all notes of this new chord towards "higher" or "lower" occurs. Thus the frequency ratios of the variable tuning will be retained. Since such a shift towards "higher" or "lower" could occur in exceptional cases a number of times in succession in the same direction, it is preferably provided that this additional correction be limited, preferably to a value below 16 cents in one direction in total.

The invention also relates to a pitch control system for a musical instrument for carrying out the method as described above, with an input device for the input of note input signals in a pre-determined fixed tuning, especially the synchronously vibratingly tempered tuning, and having a note producing device, to which the note input signals are applicable, comprising a chord recognition circuit, which at every input signal pattern corresponding to a chord ascertains whether this input signal pattern corresponds to a chord pattern from a pre-determined quantity of chord patterns, a signal pattern store circuit (34) in which a signal pattern is stored for every chord pattern of the predetermined quantity of chord patterns, including a signal allocated to one pre-determined fundamental note of the chord pattern in each case, a control circuit which, when the chord recognition circuit ascertains that an input signal pattern corresponding to one of the pre-determined chord patterns is applied, causes the signal pattern store circuit to deliver the signal pattern, corresponding to the ascertained chord pattern to the note generation device, for the generation of the respective chord in the variable tuning, the fundamental note of the chord being corrected in relation to the pre-determined fixed tuning and the other notes of the chord, starting from the corrected fundamental note, being corrected according to the variable tuning.

As signal patterns stored in the chord pattern store circuit, signals directly corresponding to the desired chord in the variable tuning, for example stating their frequency, can be stored. It is however especially preferred that correction signal patterns are stored as signal patterns in the chord pattern store circuit, for the correction of the note input signals according to the variable tuning, and that a correction circuit is provided to which the note input signals and the correction signals of the correction signal patterns are applicable, and which delivers, as output signals, the note input signals corrected in accordance with the correction signals, to the note producing device. This form of embodiment of the invention leads to a simplified construction of the control system, especially because it permits a reduction in the store requirement of the chord pattern store circuit (12 storage places per correction signal pattern).

In order to facilitate the progress of the method in the chord recognition circuit too, with reduced store requirement, it is proposed that a definition octave store is provided having 12 storage places which are allocated to the 12 different notes of a pre-determined octave, where in the examination of an initial signal pattern corresponding to a chord a storage place is occupied when the note corresponding to this storage place occurs in the chord in any desired octave. By reason of this projection of the input signal pattern on to the definition octave it is merely necessary to work with correspondingly reduced quantities of information.

It is further proposed that a work store is provided having 12 storage places, into which the stored content of the definition octave store is transferrable, and a shift counter which, starting from the counter value "0", is increased by "1" each time when the stored content of the work store is shifted by one storage place in a predetermined direction.

Correspondingly, a chord pattern store can be provided having in each case a storage line allocated to one of the chord patterns of the pre-determined quantity of chord patterns, especially with 12 storage places in each case. By reason of the mentioned projection of the input signal pattern on to the definition octave the chord patterns to be compared therewith can likewise be limited to one octave (12 storage places). In the case of formation of the work store as shift register store it is possible to shift the store content concerned in the predetermined direction until an occupied storage place corresponding to a chord note has arrived at the corresponding end of the work store. With the input signal chord "marginally adjusted" in this manner then in sequence the likewise "marginally adjusted" chord patterns from the chord pattern store are compared.

Furthermore a chord store can be provided having 12 storage places allocated to each note of an octave, for the storage of the last recognised chord. This gives the possibility of abstaining from the chord pattern comparison, if the same chord is played a number of times in succession. Moreover this comparison of the played notes with the chord store offers the advantage that the frequency of the notes does not change if, following upon a recognised and frequency-corrected chord, chords from a partial quantity of the notes of the preceding chord or even individual notes of this chord are played.

It is further possible for a correction factor store to be provided, having storage lines, especially having in each case 12 storage places allocated to each of the 12 different half-notes of an octave, which are allocated each to a chord pattern of the pre-determined quantity of chord patterns.

It is further proposed that an output store is provided, especially having in each case 12 storage places allocated to each of the 12 different half-notes of an octave, into which the content of the storage line, allocated to a recognised chord, of the correction factor store can be transferred, and the stored content of which is displaceable preferably in a pre-determined direction. Thus it is possible in a simple manner to take account of the marginal adjustment, effected to facilitate the chord pattern comparison, in the issue of the correction factors, by appropriate shifting back in the output store.

The invention will be explained hereinafter by reference to Tables designated by I–VI at the end of the description and with reference to the drawing.

Table I indicates the designation of the function of the notes of a series of selected chords in the representation as selected here;

Table II indicates the frequency ratios of the notes of a chord, in relation to one another, namely both in the harmonic tuning and in the tempered tuning;

Table III shows a list of the chords to be corrected, with the associated correction values;

Table IIIA shows a list according to Table III, with modified correction values;

Table IV indicates for each of the selected chords the associated chord pattern stored in the chord recognition store;

Table V allocates the chord pattern numbers according to Table IV to the note examples according to Figure III;

Table VI shows the effect of a chord pattern shift by half-notes.

Figure 3:
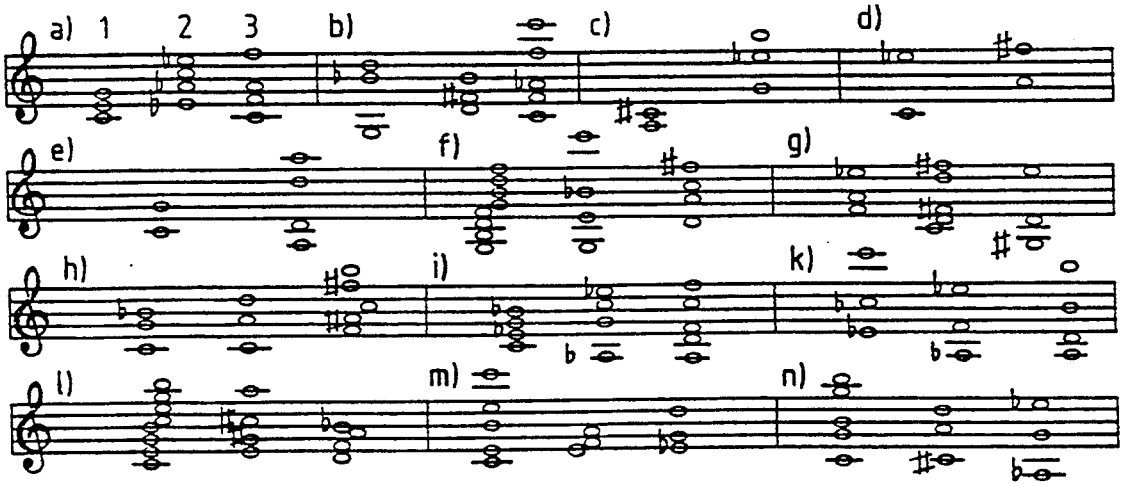
FIG. 3 shows a series of musical examples designated by a–n.
Figure 3A:
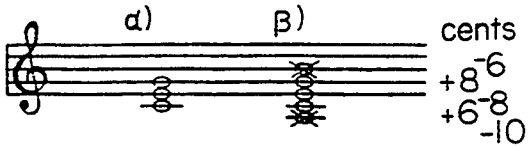

FIG. 3*a* shows further notational examples and

Figure 4:
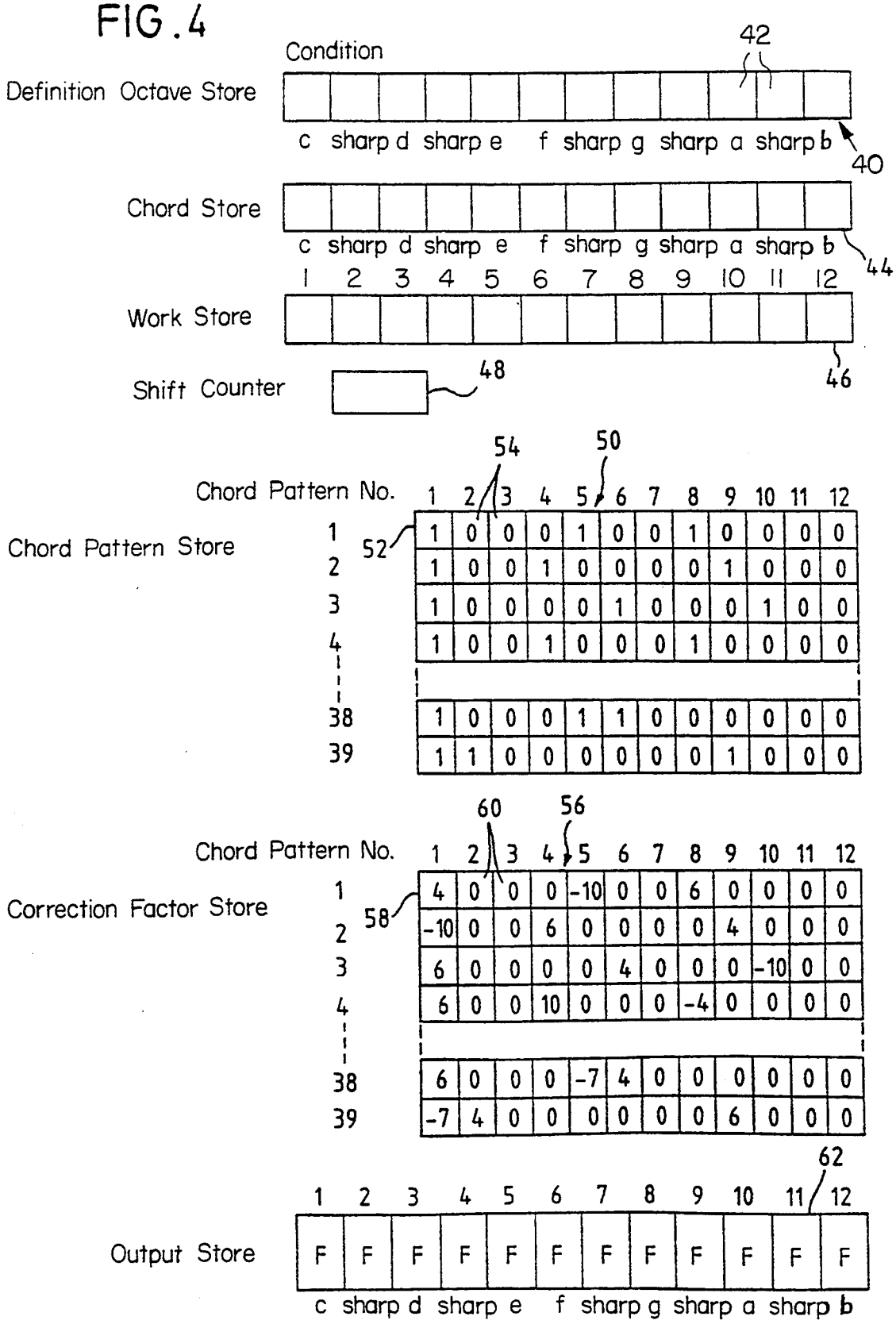

FIG. 4 shows the occupation of a series of stores used for the method according to the invention.

Figure 5:
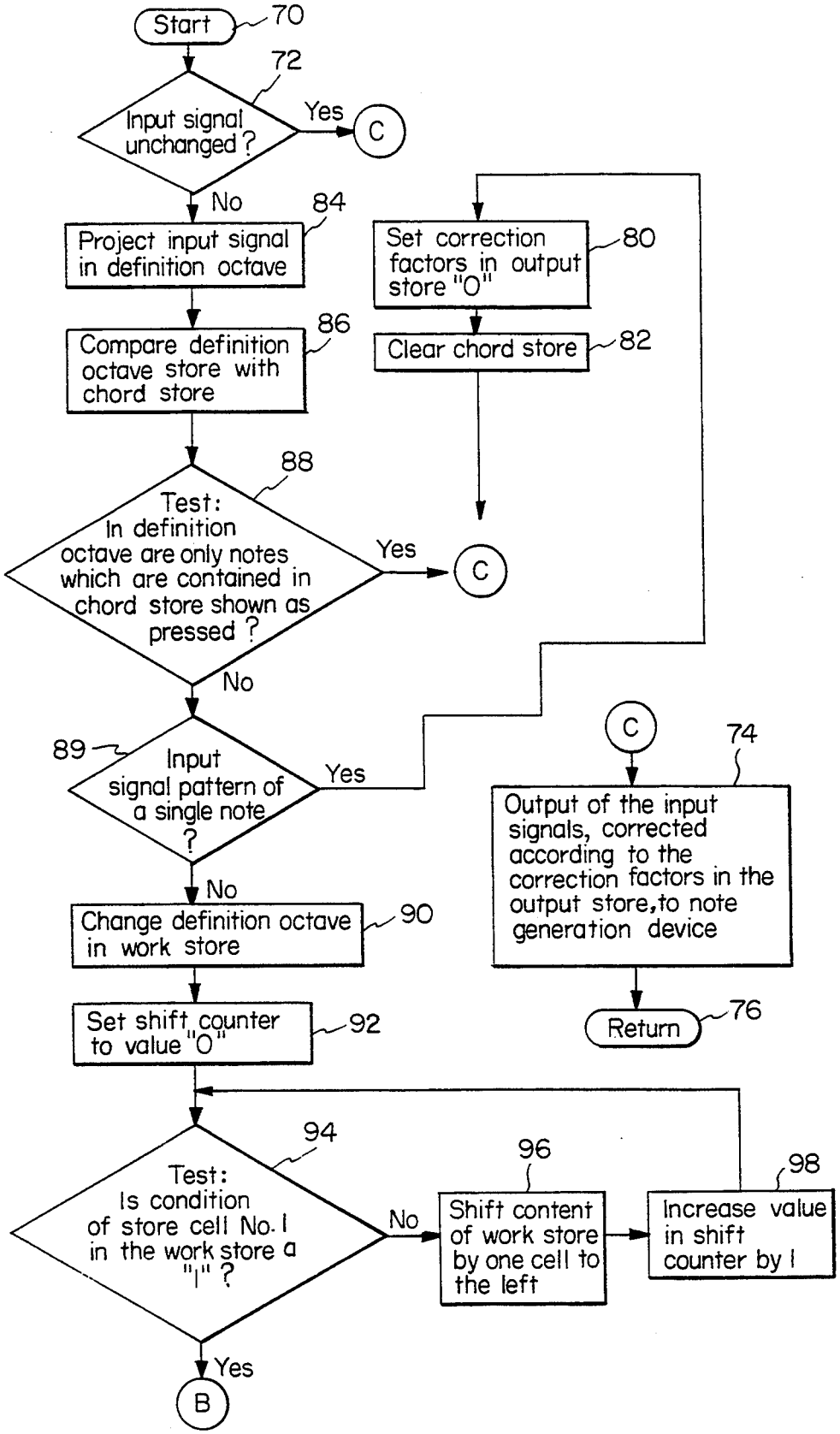

FIG. 5 shows the upper half of a flow diagram.

Figure 6:
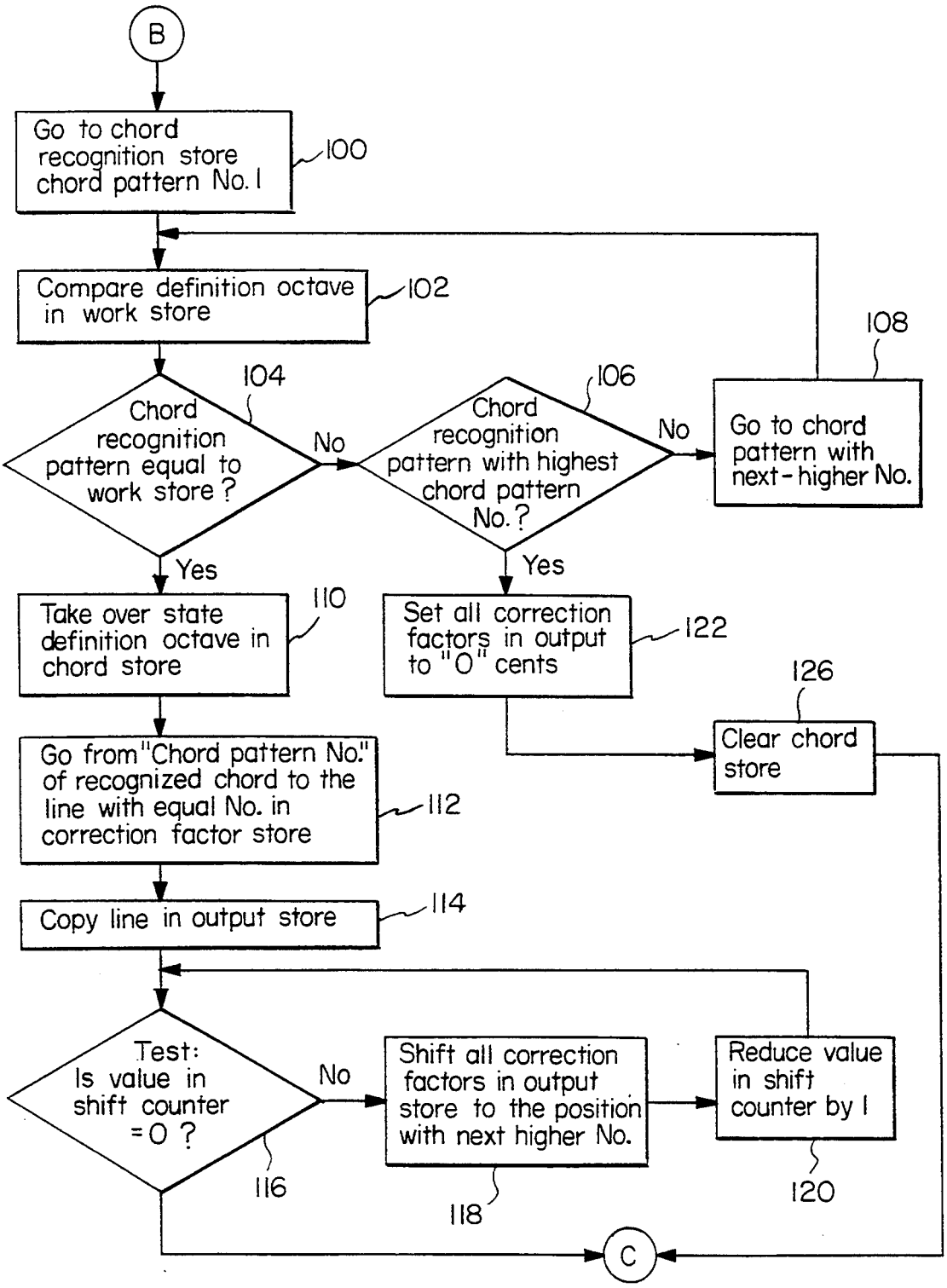

FIG. 6 shows the lower half of the said flow diagram.

In the method for pitch control according to the invention as described in detail below commencement will be made from a fixed tuning which corresponds to the tempered tuning with division of an octave into 12 equal half notes, that is with a frequency ratio of $\sqrt[12]{2}$ corresponding to 100 cents. However other fixed starting tunings are also conceivable, as for example the tunings as stated in DE-PS 2,558,716. In order that different keys may be played and key modulations may also be executed, in the case of instruments which, in contrast for example to bowed instruments and wind instruments, cannot be retuned by the player during playing, it is necessary to effect such a fixed tuning, as in keyed instruments pianoforte and organ (pipe or electronic). According to the invention now for instruments which permit multi-part playing and thus the playing of chords, now a frequency correction of the notes should be effected in such manner that the chords are harmonically purely tuned. For this purpose the instrument must comprise a note generation device which permits the production of frequency-corrected notes. This prerequisite is provided from the outset in "electronic organs" or "synthesisers". However it is also conceivable to use a pipe organ in which several pipes of different pitch (for example length) are allocated to each individual note, with actuation according to choice of the pipe desired in each case. A pipe organ can also be used in which pipes with variable pitch (for example variable length) are used in order to render possible the desired retuning of the pipe during playing.

Table V indicates those chords which are proposed for the harmonically pure tuning, where according to the utilisation case less important chords can be dropped or further chords can be added. Furthermore chords with more than four different notes will be disregarded in the example of execution. All chords will be recognised and corrected not only in their basic position according to Table I (fundamental note G as lowest note), but also in all reversals, positions and duplications. This is achieved in that all notes from all octaves are projected on to one octave, designated as "definition octave", consisting for example of the 12 succeeding half notes from c′ to b′. If for example the three chords of the example a according to FIG. 3 are considered, then in the C major chord designated by a1 the note C is the lowest note, if it is projected on to the definition octave from c′ to b′, the note E is the next higher and the note G the highest on this definition octave, so that this chord is represented on the definition octave exactly as reproduced, and can be identified by chord pattern No. 1 according to Table IV. The chord a2 is an A flat major triad, in which its notes, projected on to the said definitive octave, would be read from below upwards in the sequence C, E flat and A flat, which conforms with the chord pattern No. 2 according to Table IV. Accordingly the F major triad as example a3 is read from below upwards in the sequence C, F and A and corresponds to the chord pattern No. 3 of Table IV.

The played chords thus appear, in projection on to the definition octave, in their basic position or in one of their reversals, irrespective of in which position, duplication or reversal they are played. The position of the chord in the definition octave does not have to correspond to the position in which the chord is played, but depends upon the initial and final notes of the selected definition octave and upon of which concrete notes the chord played in each case consists. As further appears from Table IV, by reference to the representation of the notes on the definition octave and of the specific pattern of each chord it is possible to determine the function of the individual notes of the chord (here represented as letters G, M, T, Q, R and S according to Table I) and thus a quite specific correction value of tempered to harmonic tuning can be allocated to each note with a specific function in the chord.

Figure 1:
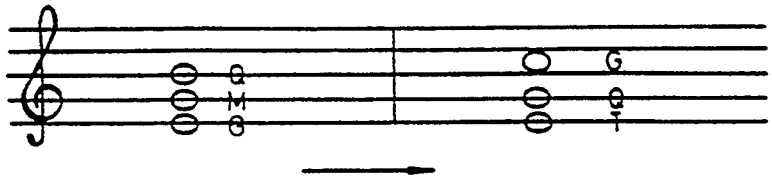
FIG. 1 shows a musical example (transition from an E minor chord to a C major chord) with table for the explanation of the additional correction.
Figure 2:
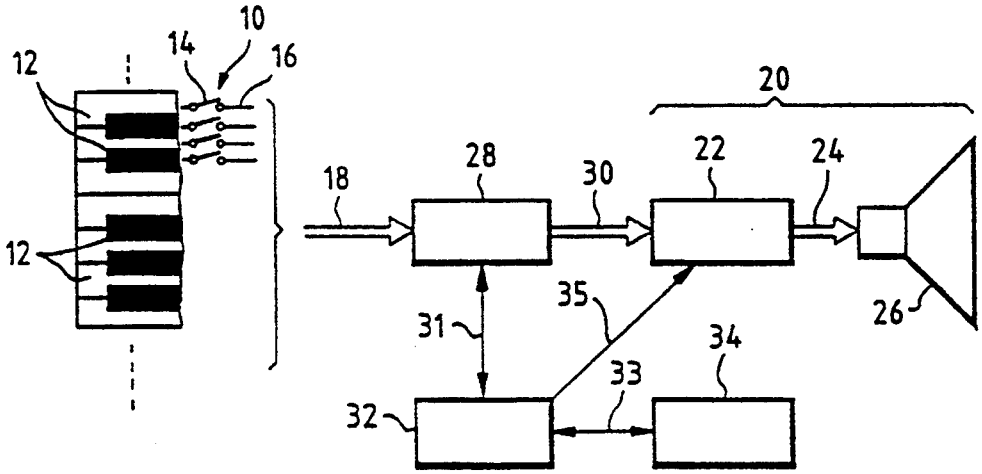
FIG. 2 shows a greatly simplified circuit diagram.

By reference to FIG. 2 in combination with Table II it is to be demonstrated that audible discords can occur even in the case of individually harmonically pure tuning of successive chords. At the top in FIG. 1 there is represented the transition from an e minor triad to a C major triad. In order to have a fixed reference system, by way of example the chord note in each case is fixed in the function G in the fixed (tempered) tuning, that is at the fundamental note e (=330 Herz). The notes g (with function M) and b (with function Q), which accordingly in the case of tempered tuning (see Table II) would have frequencies of 392 (=300 cents) and 494 Herz (=700 cents), are then corrected to the frequencies 396 Herz and 495 Herz. Accordingly the fundamental note c (with function G) of the C major chord is fixed at 523 Herz with the harmonic frequencies 392 and 327 for the lower notes e (with function Q) and g (with function T).

If now one compares the two lowermost notes of the two chords, which both correspond to the same note, namely the note e. these notes, played in immediate succession, due to the correction to harmonic tuning have a frequency difference of about 1%. This is also valid for the two middle notes of the chords with 396 and 392 Herz respectively. Such a frequency difference of inherently equal notes played in immediate succession is audible and will be felt to be unpleasant.

In order to avoid this effect, the major triads, harmonically tuned as before, are shifted as a whole to higher frequencies and accordingly the minor triads, tuned harmonically purely as before, are shifted to lower frequencies. According to Table III a frequency shift of the major triads upwards by 4 cents and a frequency shift of the minor triads downwards by 6 cents has proved especially advantageous.

On the basis of this additional correction the frequency difference of the relevant notes now lies with 1 Herz in each case, below $\frac{1}{3}$% and accordingly is no longer audible.

In Table III in the third column from the right the preferred additional corrections for the stated chords are listed.

In Table III A there are stated alternative additional corrections for a series of chords which are distinguished by improved fifth purity.

FIG. 2 shows a purely diagrammatic circuit diagram for the explanation of the method. An input device 10 for the input of tone input signals in the fixed tuning is symbolised as a row of piano keys 12 for the actuation of switches 14 allocated to each key 12. The leads 16 issuing from the switches 14 are combined into a collective lead 18. A note generating device 20 comprises a note signal output circuit 22, which in general is provided with note frequency generators, and through a lead 24 actuates one or more loudspeakers 26. In place of the loudspeaker 26 it is also possible for a recording apparatus, for example an acoustic tape, to be provided for "interim music storage". The lead 18 enters a chord pattern recognition circuit 28, from which again a lead 30 issues for connection of the circuits 28 and 22. The input device 10 and the note generation device 22 correspond in construction and function to the corresponding components of conventional electronic keyed instruments.

The chord pattern recognition circuit 28 is connected through a lead 31 with a control circuit 32 which again is connected through a lead 33 with a signal pattern storage circuit 34. The control circuit 32 is additionally connected through a lead 35 with the note signal output circuit 22.

The general function of the circuit arrangement according to FIG. 2 is the following:

The note input signals are fed through the lead 18 to the chord recognition circuit 28. The chord recognition circuit examines whether an input signal pattern corresponding to a chord and consisting of several different notes corresponds to a chord pattern from a pre-determined quantity of chord patterns. If this is the case, then this is notified to the control circuit 32 which calls forth the correction signals allocated to this chord and forwards them through the lead 35 to the note signal output circuit 22, which accordingly corrects the note input signal fed to it through the lead 30 and delivers them as corrected output signals to the loudspeaker 26.

The method as described is naturally not limited to such an electric circuit arrangement, but can also be realised by appropriately programmed programme-controlled equipment.

In FIGS. 4 and 5 a corresponding programme progress is represented, again purely diagrammatically. The stores mentioned in the programme progress diagram are explained in greater detail in FIG. 4. A definition octave store 40 is seen having twelve storage places 42, which in sequence each comprise a half note of the scale, for example beginning at the note c. A chord store 44 has the same construction. A work store 46 likewise comprises twelve storage places; however the work store 46 is formed as shift register store, so that the storage places are merely numbered through from 1 to 12 and not allocated to any note of the scale. A shift counter 48 is allocated to the work store 46 and counts the shift steps, each by one storage place corresponding to a half note of the scale, executed in each case.

A chord recognition store 50 comprises storage lines 52 allocated each to one of the chord patterns according to Table IV, each with twelve storage places 54. As appears from a comparison, for example of the first four storage lines, with the Table IV chord patterns Nos. 1–4, the storage place occupation in the chord recognition store 50 corresponds to the chord patterns. For the chords proposed here for correction thirty-nine lines 52 are provided.

A correction factor store 56 is likewise organised in thirty-nine lines 58 each of twelve storage places 60. While in the chord recognition store there stands, according to the chord pattern in each case, either a "1" (that is chord note) or a "0" (that is no chord note), in the correction factor store 56 at those storage places which correspond to the corresponding storage places provided with "1" in the chord recognition store 50 the correction signals allocated to the respective note according to Table III are stored. These correction signals correspond in each case to the total correction in cents from the second column from the right of Table III. If for example one considers the third line in the correction factor store 56, which is allocated to chord pattern No. 3, then the number "6" is stored in the first storage place—this because this note, according to Table IV, corresponds in function to the note with the function Q (=fifth), to which note again, according to Table III, uppermost line, a correction of +6 cents is allocated. The storage places 60 of the store 56, which correspond in location to the storage places 50 occupied with "0", are likewise occupied with "0".

Finally an output store 62 is also provided again having twelve storage places, which are numbered in order to indicate that this store too is formed as shift register store.

In the case of the circuit arrangement principle as shown in FIG. 2 the stores 40, 44, 46 and 50 can be allocated to the circuit 28, the store 56 to the circuit 34 and the store 62 to the circuit 32.

The progress of the programme or method appears from FIGS. 5 and 6. Commencing from the starting block 70, it is tested in the next succeeding decision block 72 whether the input signals delivered by the note production device 10 are unchanged, that is whether the momentary switch condition remains further, that is for example one or more keys are unchangedly pressed. If this is the case, the programme jumps to the block 74, to be explained later, and then to the "return block" 76. The result is the unchanged output of the input signals corrected as hitherto, to the note production device 20, so that the notes just played continue to sound in unchanged tuning.

If on the other hand the input signals are changed, the input signal pattern is charged according to a block 84 into the definition octave store 40, namely in a manner in which then for example the store line 42 allocated to the note c is occupied with "1", if one or more keys each allocated to the note c in any octave are pressed. Incidentally the storage places receive the store content "0". Thus in the result notes of like name of any desired octaves are linked by the logic function "or", so that the desired projection of the introduced chord on to the definition octave is obtained.

In the subsequent block 86 it is examined whether the chord now struck consists exclusively of chord notes of the chord last struck and recognised as chord pattern. If this examination in the decision block 88 shows that a pure repetition is present, then to shorten the method a move is made to the block 74, with the result that the new chord sounds with the frequency corrections in accordance with the chord last played, and the new "chord" can consist of only one single chord note of the previously played chord recognised as chord pattern.

If however the new chord differs in at least one note from this previously played chord, then the programme steps further to a decision block 89, in which it is examined whether the input signal pattern corresponds only to one single note If this is the case the programme goes over to a block 80 in which the already mentioned output store 62 is cleared, just like the chord store 44 in a subsequent block 82, whereupon the programme proceeds again to a block 74 for the output of the input signal corresponding to the single note to the note generation device 20, namely without correction, since the correction factors are set to "0" in the output store. Thus the single note sounds in tempered tuning.

If on the other hand it is ascertained that the input signal pattern corresponds to several notes, then the content of the definition octave store 40 will be charged according to a block 90 into the work store 46. The shift counter 48 is set in an adjoining block 92 to the number "0". The next programme loop serves to shift the store content of the work store until a "1" has arrived at for example the left edge of the storage line of shift register type which forms the work store 46. This can also be designated as marginal adjustment. In this way the comparison with the chord patterns in the chord recognition store is to be facilitated, since the content of the corresponding lines 52 of this store 50 is likewise marginally adjusted, as may be seen from FIG. 4.

In a decision block 94 following upon the block 92 it is examined in this connection whether a "1" is situated in storage line No. 1 of the work store 46. If this is not the case, the programme advances to a block 96, in order to shift the content of the work store 46 one line (corresponding to a half note) to the left. At the same time in the block 98 the store value of the shift counter 48 is increased by "one". Next the programme returns to the decision block 94. The loop formed in this way is run through until the marginal adjustment is achieved, that is a "1" is stored in the store line 1.

The programme then proceeds to a block 100 (FIG. 6). In that action the chord recognition store 50 is actuated, namely its first line with the chord pattern No. 1. In the following programme loop the marginally adjusted content of the work store 46 is compared in sequence with all chord patterns, until either equality with a specific chord pattern has been ascertained or until all chord patterns have been taken through without conformity. In one block 102 of the loop the chord recognition pattern in reach case is compared with the content of the work store. In a subsequent decision block 104 a transfer is made to a next-succeeding decision block 106 within the loop, if the momentary chord recognition pattern does not correspond to the content of the work store. In the decision block 106 it is tested whether all the chord patterns have already been examined. If this is not yet the case, that is the actual chord pattern number is less than the maximum chord pattern number (39 in the example according to FIG. 4), then the programme passes to a block 108 in which actuation of the next succeeding line of the chord recognition store 50 is instigated. Then the programme returns to the block 102, within this loop.

If in the decision block 104 on the other hand it is ascertained that the played chord corresponds to a pattern chord, that is the content of the work store corresponds fully to that of a store line of the chord recognition store, the programme leaves the said loop and passes over from the decision block 104 to a block 110 according to which the content of the chord store 44 is actualised by take-over of the content of the definition octave store 40. A block 112 follows, according to which that storage line of the correction factor store 56 is actuated the number of which corresponds to that of the momentarily actuated line of the chord recognition store 50, that is the number of that chord pattern, which has been ascertained as identical with the momentarily played chord. This line is copied into the output store 652 in a subsequent block 114.

In correspondence with the chord recognition store 50, the contents of the store lines 58 are also marginally adjusted in the correction factor store 56. In order that the marginally adjusted correction factors ascertained in this way may be allocated in the note production to the played chord notes in their unshifted position, the marginal adjustment of these correction factors in the output store 62 is reversed. For this purpose there serves a programme loop following the block 114. Following upon the block 114, as part of the loop, a decision block 116 is approached, where it is tested whether a marginal adjustment in the loop formed by the blocks 94, 96 and 98 should have been effected. In the case of the chord marginally adjusted from the outset in the definition octave store (that is in the case of a played chord containing the note c, if the definition octave commences with the note c), a shift in the work store is naturally not necessary. In the latter case the shift counter would still have the value "0". If this is not the case, then in the loop the block 116 is followed by a block 118, according to which the store content of the output store 62 is shifted to the right, that is to the next higher line number. Thereupon in a block 120 the value in the shift counter is reduced by one. Then the programme loop returns to the decision block 116. Thus the loop is run through until the shift counter has the value "0", so that as a result the correction factors stand in the output store at the same position as the notes of the definition octave.

Regarding the storage place occupation of the output store 62 it should be added that when for example it is ascertained that chord pattern No. 4 is present, the output store accordingly has F=0 at each of the positions 2, 3, 5, 6, 7, 9, 10, 11 and 12, and at position 1 F=−6, at position 4 F=10 and position 8 F=−4. F=0 signifies that no pitch correction is to be effected at the note concerned, that is this sounds in tempered tuning. Otherwise the note will be corrected according to the stated correction factor (in cents).

Since the initial displacement is merely reversed within the octave of the work store (in the loop with the blocks 94, 96 and 98) later in the loop 116, 118, 120 within the octave of the output store (with identical chord pattern), there is no danger of the output store overflowing, that is a correction factor different from zero being pushed out of the store.

It is however also conceivable to effect the chord recognition in a manner in which for each chord there is used a single chord pattern, for example chord pattern No. 1 for the major triad, which then is cyclically displaced in a shift store with twelve storage places, so that thus chord patterns 2 and 3 are also present in the interim (chord pattern 2 results for example on a cyclic displacement of chord pattern No. 1 in Table IV to the left by four half-notes). Then for each chord the one chord pattern must be shifted by a complete cycle (12 steps) and compared each time with the played chord, a marginal adjustment of this chord being unnecessary. With this procedure then the output store would have to be correspondingly cyclically organised with displacement in the opposite direction, according to the number of shift steps necessary until conformity of the chords.

Reference is to be made briefly to Table VI, from which it is to be seen that (in the case of a definition octave beginning with the note c) a played E-major triad requires four shift steps to the left in the work store 46 before the marginal adjustment is achieved. Accordingly then the store content of the output store 62, corresponding to line No. 4 of the correction factor store 56, must be shifted by four steps to the right, so that then for example the correction factor "−6 cents" stands at the storage point allocated to the note e.

After the execution of the necessary displacements in the output store (value in the shift counter=zero) the said loop is left; the programme goes over from the decision block 116 to the block 74. Now the input signals are corrected according to the correction factors in the output store. Here, independently of the octave in which the note concerned stands, the correction factor corresponding to this note according to its naming in the output store is used for the correction of this note. Thus a kind of reverse projection to the original multi-octave input signal pattern is effected. Since the correction factors state frequency ratios, these are octave-independent. In many usual note signal output circuits 22, from the outset a note frequency generator is allocated to each key 12. In accordance with the invention controllable note frequency generators are to be provided which, starting from the tempered basic tuning, are automatically retunable by reference to the correction factors.

As a result thus a harmonically corrected chord is delivered by the note generation device 20 when it has been ascertained that this chord corresponds to a predetermined chord pattern. If the chord cannot be recognised, then the chord is produced in the tempered tuning. For this purpose in the programme loop comprising the blocks 102, 104, 106, 108 a second loop exit is provided, namely in the decision block 106. If in the block 106 it is ascertained that on the one hand the played chord does not conform with the actual chord pattern (block 104) and on the other hand the highest chord number (for example 39) is reached, then the programme goes over from the Block 106 to a block 122, according to which all correction factors for the output store 62 are set at zero cents.

In a subsequent block 126 the chord store 44 is cleared. Then the programme goes over again to the block 74, that is to the output of the input signals, in this case uncorrected, to the note generation device 20. Then the programme returns by way of the "Return Block" 76 to the beginning of the programme (block 70) again. The entire programme loop can be run through with a fixed repetition frequency, independently of a key actuation of the instrument.

According to the above thus chord patterns are identified automatically and their individual notes are corrected forthwith, so that the delivered chord sounds harmonically pure. Later-struck individual notes or chords which are constituents of the last-identified chord pattern are likewise corrected. It is however also possible to continue and allocate to the individual pattern chords additional chord notes which are tuned purely in relation to the actual chord notes. If after identification of this chord subsequently one of the additional chord notes is struck, this too is correspondingly corrected.

FIG. 3A carries for example a pattern chord (C-major triad) designated for example by $\alpha$, which is extended upward by an additional chord note lying on the note stage b, at the interval of a large third from the uppermost pattern chord note and downward by an additional chord note (note a) at the interval of a small third. These additional chord notes are symbolised in the chord $\beta$ in FIG. 3A as sharpened notes. An alternating sequence of large and small thirds results.

The correction factors allocated to these individual notes, in comparison with the tempered tuning, are stated in FIG. 3A on the right beside the chord $\beta$ in cents.

If in the course of playing the chord pattern $\alpha$ is identified, then its notes are forthwith corrected too, so that this chord sounds harmonically pure; furthermore if then one or more of the notes of the chord $\beta$ also containing the additional chord notes are struck, these are in each case harmonically corrected.

TABLE I

| | Function of the individual notes in the basic position of the chord shown from below upward = from left to right |
|---|---|
| Major - triad | G T Q |
| Minor -triad | G M Q |
| Large third | G T |
| Small third | G M |
| Pure fifth | G Q |
| Small major seventh chord | G T Q R |
| Small minor seventh chord | G M Q R |

TABLE I-continued

| | Function of the individual notes in the basic position of the chord shown from below upward = from left to right |
|---|---|
| Large major seventh chord | G T Q S |

Function of the notes in the chord
G designates "fundamental note"
M designates "Small third"
T designates "Large third"
Q designates "Fifth"
R designates "Small seventh"
S designates "Large seventh"

TABLE II

| Characteristic of the note as represented | Frequency ratio to the fundamental note in Harmonically pure as fraction | Harmonically pure in Cents | Tempered in Cents | Tuning |
|---|---|---|---|---|
| G | 1 | 0 | 0 | |
| M | 6/5 | 316 | 300 | |
| T | 5/4 | 386 | 400 | |
| Q | 3/2 | 702 | 700 | |
| R | 16/9 | 997 | 1000 | |
| S | 15/8 | 1089 | 1100 | |

TABLE III

| Title of the chord proposed for frequency correction | Chord pattern No. im basic position | Function of the individual notes of the chords in basic position | Vibration ratio to note G, in cents, "tempered" | Vibration ratio to note G in cents "harmonically pure" | Correction in cents from "tempered" to "harmonically pure" | Additional correction of all chord notes in cents | Overall correction of all chord notes in cents from "tempered" to "harmonically pure" | Final Frequencies in the chords in cents, related to the fundamental note G |
|---|---|---|---|---|---|---|---|---|
| Major triad | 1 | Q | 700 | 702 | +2 | | +6 | 706 |
| | | T | 400 | 386 | −14 | +4 | −10 | 390 |
| | | G | 0 | 0 | 0 | | +4 | 4 |
| Minor triad | 4 | Q | 700 | 702 | +2 | | −4 | 696 |
| | | M | 300 | 316 | +16 | −6 | +10 | 310 |
| | | G | 0 | 0 | 0 | | −6 | −6 |
| Large third (duochord) | 7 | T | 400 | 386 | −14 | +6 | −8 | 392 |
| | | G | 0 | 0 | 0 | | +6 | 6 |
| Small third (duochord) | 9 | M | 300 | 316 | +16 | −6 | +10 | 310 |
| | | G | 0 | 0 | 0 | | −6 | −6 |
| Pure fifth (duochord) | 11 | Q | 700 | 702 | +2 | −1 | +1 | 701 |
| | | G | 0 | 0 | 0 | | −1 | −1 |
| Small major seventh chord | 13 | R | 1000 | 997 | −3 | | +1 | 1001 |
| | | Q | 700 | 702 | +2 | +4 | +6 | 706 |
| | | T | 400 | 386 | −14 | | −10 | 390 |
| | | G | 0 | 0 | 0 | | +4 | 4 |
| Small major seventh chord without fifth | 17 | R | 1000 | 997 | −3 | | +1 | 1001 |
| | | T | 400 | 386 | −14 | +4 | −10 | 390 |
| | | G | 0 | 0 | 0 | | +4 | 4 |
| Small seventh chord without third | 20 | R | 1000 | 997 | −3 | | −1 | 999 |
| | | Q | 700 | 702 | +2 | +2 | +4 | 704 |
| | | G | 0 | 0 | 0 | | +2 | 2 |
| Small minor seventh chord | 23 | R | 1000 | 997 | −3 | | (−9)0 | (991)1000 |
| | | Q | 700 | 702 | +2 | −6 | −4 | 696 |
| | | M | 300 | 316 | +16 | | +10 | 310 |
| | | G | 0 | 0 | 0 | | −6 | −6 |
| Small minor seventh chord without fifth | 27 | R | 1000 | 997 | −3 | | (−9)0 | 1000 |
| | | M | 300 | 316 | +16 | −6 | +10 | 310 |
| | | G | 0 | 0 | 0 | | −6 | −6 |
| Large major seventh chord | 30 | S | 1100 | 1089 | −11 | | −7 | 1093 |
| | | Q | 700 | 702 | +2 | +4 | +6 | 706 |
| | | T | 400 | 386 | −14 | | −10 | 390 |
| | | G | 0 | 0 | 0 | | +4 | 4 |
| Large major seventh chord without fifth | 34 | S | 1100 | 1089 | −11 | | −7 | 1093 |
| | | T | 400 | 386 | −14 | +4 | −10 | 390 |
| | | G | 0 | 0 | 0 | | +4 | 4 |
| Large seventh chord without third | 37 | S | 1100 | 1089 | −11 | | −7 | 1093 |
| | | Q | 700 | 702 | +2 | +4 | +6 | 706 |
| | | G | 0 | 0 | 0 | | +4 | 4 |

TABLE IIIA

| Title of the chord proposed for frequency correction | Chord pattern No. im basic position | Function of the individual notes of the chords in basic position | Vibration ratio to note G, in cents, "tempered" | Vibration ratio to note G in cents "harmonically pure" | Correction in cents from "tempered" to "harmonically pure" | Additional correction of all chord notes in cents | Overall correction of all chord notes in cents from "tempered" to "harmonically pure" | Final Frequencies in the chords in cents, related to the fundamental note G |
|---|---|---|---|---|---|---|---|---|
| Small seventh chord | 20 | R | 1000 | 1018 | +18 | | +9 | 10009 |
| without third | | Q | 700 | 702 | +2 | −9 | −7 | 693 |
| | | G | 0 | 0 | 0 | | −9 | −9 |
| Small minor seventh | 23 | R | 1000 | 1018 | +18 | | +9 | 1009 |
| chord | | Q | 700 | 702 | +2 | | −7 | 693 |
| | | M | 316 | 316 | +16 | −9 | +7 | 307 |
| | | G | 0 | 0 | 0 | | −9 | −9 |
| Small minor seventh | 27 | R | 1000 | 1018 | +18 | | +9 | 1009 |
| chord without | | M | 300 | 316 | +16 | −9 | +7 | 307 |
| fifth | | G | 0 | 0 | 0 | | −9 | −9 |
| Large major seventh | 30 | S | 1100 | 1088 | −12 | | −6 | 1094 |
| chord | | Q | 700 | 702 | +2 | | +8 | 708 |
| | | T | 400 | 386 | −14 | +6 | −8 | 392 |
| | | G | 0 | 0 | 0 | | +6 | 6 |
| Large major seventh | 34 | S | 1100 | 1088 | −12 | | −6 | 1094 |
| chord without | T | 400 | 386 | −14 | +6 | −8 | 392 | |
| fifth | | G | 0 | 0 | 0 | | +6 | 6 |
| Large seventh chord | 37 | S | 1100 | 1088 | −12 | | −8 | 1092 |
| without third | | Q | 700 | 702 | +2 | +4 | +6 | 706 |
| | | G | 0 | 0 | 0 | | +4 | 4 |

TABLE IV

| Chord Name | Chord Pattern No. | Screen representations of "definition octave" and functions of the "1" on the screen |
|---|---|---|
| Major triad | 1 | 1 0 0 0 1 0 0 1 0 0 0 0<br>G T Q |
| | 2 | 1 0 0 1 0 0 0 0 1 0 0 0<br>T O G |
| | 3 | 1 0 0 0 0 1 0 0 0 1 0 0<br>Q G T |
| Minor triad | 4 | 1 0 0 1 0 0 0 1 0 0 0 0<br>G M Q |
| | 5 | 1 0 0 0 1 0 0 0 0 1 0 0<br>M Q G |
| | 6 | 1 0 0 0 0 1 0 0 1 0 0 0<br>Q G M |
| Large third (duochord) | 7 | 1 0 0 0 1 0 0 0 0 0 0 0<br>G T |
| | 8 | 1 0 0 0 0 0 0 0 1 0 0 0<br>T G |
| Small third | 9 | 1 0 0 1 0 0 0 0 0 0 0 0<br>G M |
| | 10 | 1 0 0 0 0 0 0 0 0 1 0 0<br>M G |
| Pure fifth | 11 | 1 0 0 0 0 0 0 1 0 0 0 0<br>G Q |
| | 12 | 1 0 0 0 0 1 0 0 0 0 0 0<br>Q G |
| Small major seventh chord | 13 | 1 0 0 0 1 0 0 0 0 1 0<br>G T Q R |
| | 14 | 1 0 0 1 0 0 1 0 1 0 0 0<br>T Q R G |
| | 15 | 1 0 0 1 0 1 0 0 0 1 0 0<br>Q R G T |
| | 16 | 1 0 1 0 0 0 1 0 0 1 0 0<br>R G T Q |
| Small major seventh chord without fifth | 17 | 1 0 0 0 1 0 0 0 0 0 1 0<br>G T R |
| | 18 | 1 0 0 0 0 0 1 0 1 0 0 0<br>T R G |
| | 19 | 1 0 1 0 0 0 1 0 0 0 0 0<br>R G T |
| Small seventh chord without third | 20 | 1 0 0 0 0 0 0 1 0 0 1 0<br>G Q R |
| | 21 | 1 0 0 1 0 1 0 0 0 0 0 0<br>Q R G |
| | 22 | 1 0 1 0 0 0 0 0 0 1 0 0<br>R G Q |
| | 23 | 1 0 0 1 0 0 0 1 0 0 1 0<br>G M Q R |
| | 24 | 1 0 0 0 1 0 0 1 0 1 0 0<br>M Q R G |
| | 25 | 1 0 0 1 0 1 0 0 1 0 0 0<br>Q R G M |
| | 26 | 1 0 1 0 0 1 0 0 0 1 0 0<br>R G M Q |
| Small minor seventh chord without fifth | 27 | 1 0 0 1 0 0 0 0 0 0 1 0<br>G M R |
| | 28 | 1 0 0 0 0 0 0 1 0 1 0<br>M R G |
| | 29 | 1 0 1 0 0 1 0 0 0 0 0<br>R G M |
| Large major seventh chord | 30 | 1 0 0 0 1 0 0 1 0 0 0 1<br>G T Q S |
| | 31 | 1 0 0 1 0 0 0 1 1 0 0 0<br>T Q S G |
| | 32 | 1 0 0 0 1 1 0 0 0 1 0 0<br>Q S G T |
| | 33 | 1 1 0 0 0 1 0 0 1 0 0 0<br>S G T Q |
| Large major seventh chord without fifth | 34 | 1 0 0 0 1 0 0 0 0 0 0 1<br>G T S |
| | 35 | 1 0 0 0 0 0 0 1 1 0 0 0<br>T S G |
| | 36 | 1 1 0 0 0 1 0 0 0 0 0 0<br>S G T |

TABLE IV-continued

| Chord Name | Chord Pattern No. | Screen representations of "definition octave" and functions of the "1" on the screen |
|---|---|---|
| Large seventh chord without third | 37 | 1 0 0 0 0 0 0 1 0 0 0 1<br>G Q S |
| | 38 | 1 0 0 0 1 1 0 0 0 0 0 0<br>Q S G |
| | 39 | 1 1 0 0 0 0 0 0 1 0 0 0<br>S G Q |

TABLE V

| Chord Name | Chord Pattern No. | Note examples (see FIG. 3) |
|---|---|---|
| Major triad | 1–3 | a) |
| Minor triad | 4–6 | b) |
| Large third (duochord) | 7–8 | c) |
| Small third (duochord) | 9–10 | d) |
| Pure fifth (duochord) | 11–12 | e) |
| Small major seventh chord | 13–16 | f) |
| Small major seventh chord without fifth | 17–19 | g) |
| Small seventh chord without third | 20–22 | h) |
| Small minor seventh chord | 23–26 | i) |
| Small minor seventh chord without fifth | 27–29 | k) |
| Large major seventh chord | 30–33 | l) |
| Large major seventh chord without fifth | 34–36 | m) |
| Large seventh chord without third | 37–39 | n) |

TABLE VI

| For chord pattern | Number of steps to left, until first cell contains a "l' | following chord is played |
|---|---|---|
| 1 | 0 | C-Major-triad |
| 1 | 1 | Cis = Des C-Major-triad |
| 1 | 2 | D-Major-triad |
| 1 | 3 | Dis = Es D-Major-triad |
| 1 | 4 | E-Major-triad |
| 2 | 0 | Gis = As-Major-triad |
| 2 | 1 | A-Major-triad |
| 2 | 2 | Ais = B-Major-triad |
| 2 | 3 | H-Major-triad |
| 3 | 0 | F-Major-triad |
| 3 | 1 | Fis = Ges-Major-triad |
| 3 | 2 | G-Major-triad |

We claim:

1. Method of automatically correcting a pitch of a musical instrument including a note input device for inputting note input signals according to a first intonation system, and a tone generating device for receiving the note input signals and for generating corresponding tones, said method comprising the steps of:

(i) determining whether an input signal pattern comprising at least two note input signals corresponds to one of a plurality of predetermined chord patterns, comprising each a predetermined fundamental note; and (ii) in the case of correspondence of the input signal pattern to one of a plurality of predetermined chord patterns, replacing the input signal pattern by a corrected input signal pattern, said corrected input signal pattern being determined on the basis of the input signal pattern corrected by first and second correction factors attributed to the one chord pattern, with the first correction factors being determined to correct according to a second intonation system different from the first intonation system, in particular, an intonation system with "just" intonation, all note input signals except for a note input signal corresponding to the fundamental note of the respective chord pattern, and with the second correction factors being applied to all of the note input signals of the input signal pattern with a same correction factor value for all of the note input signals, and being determined to shift all of the note input signals to one of higher and lower signal values dependent on whether the first correction factors shift the note input signals on average to the one of higher and lower signal values.

2. A method according to claim 1, wherein a second correction factor is determined so that a shift of a mean input note signal of the note input signals of the input signal pattern is at least partially compensated by the second correction factor, with the shift being produced only by a respective first correction factor.

3. A method according to claim 2, wherein the first and second correction factors are indicative of relative frequency changes, and wherein the second correction factor of the one chord pattern essentially corresponds in value to a mean value of the first correction factor of the one chord pattern, and corresponds in sign to an opposite of a sign of the mean value.

4. A method according to claim 1, wherein said determining step includes projecting the input signal pattern onto a predetermined 12-tone octave and comparing the input signal pattern with each of the predetermined chord patterns defined within the octave.

5. A method according to claim 4, comprising the step of shifting the input signal pattern within the 12-tone octave, as a whole, in a first direction by half-note steps until a signal of the input signal pattern is present at a predetermined end of the 12-tone octave, wherein a number of first shift steps needed for the shift are counted, and wherein the shifted input signal pattern is compared with the predetermined chord patterns, with the predetermined chord patterns likewise comprising a chord pattern note at the predetermined end of the 12-tone octave.

6. A method according to claim 5, comprising the steps of loading, in the case of conformity of the input signal pattern with one of the predetermined chord patterns, a correction signal pattern corresponding to the one chord pattern into a 12-tone output store, and shifting the correction signal pattern, as a whole, in a second direction by half-note steps within the output store for a number of second shift steps, with the number of second shift steps being equal to the number of first shift steps and with a second shift direction being opposed to the first shift direction.

7. A method according to claim 6, wherein each of the correction signals of the correction signal pattern comprises the first and second correction factors.

8. A method according to claim 6, wherein the correction signals of the correction signal patterns define relative frequency changes.

9. A method according to claim 5, comprising the step of shifting each of the predetermined chord patterns cyclically within the 12-tone octave, as a whole, in a third shift direction by half-note steps, wherein after each step, the input signal pattern is compared with the one chord pattern, wherein the shifting is ended when conformity between the unshifted input signal pattern and the one of the chord patterns is reached, and wherein a number of third shift steps is needed until conformity is reached, is counted.

10. A method according to claim 9, comprising the steps of loading, in the case of conformity of the input signal pattern with the one chord pattern, a correction signal pattern corresponding to the one chord pattern into a 12-tone-output store, and cyclically shifting the correction signal pattern, as a whole, in a fourth shift direction by half-note steps within the output store for a number of fourth shift steps, the number of fourth steps being equal to the number of third shift steps, and the fourth direction being opposite to the second direction.

11. A method according to claim 10, wherein the correction signals of the correction signal patterns each comprises the first and second correction factors.

12. A method according to claim 11, wherein the correction signals of the correction signal patterns define relative frequency changes.

13. A method according to claim 1, comprising the step of checking, after determining a correspondence of the note input signal pattern with one of the chord patterns, following input signal patterns, whether at least one note of the following input signal pattern corresponds to a respective note of the one chord pattern, wherein, in case of a correspondence, the at least one note of the following input signal pattern is corrected by the same first and second correction factors as a respective note of the one chord pattern.

14. A method according to claim 1, comprising the step of comparing, in the case of a multimanual input device, input signal patterns of respective input devices separately with chord patterns of the predetermined chord patterns.

15. A method according to claim 14, comprising the step of checking, after determining the correspondence of an input signal pattern of one of the input devices with one of the chord patterns, the following input signal patterns of all input devices whether at least one note corresponds to a respective note of the one chord pattern, wherein in the case of a correspondence, the at least one note of the following input signal pattern is corrected by the same first and second correction factors as the respective note of said one chord pattern.

16. A method according to claim 1, comprising the step of comparing only input signal patterns, which correspond to chord patterns having at least three different notes, with the chord patterns of the plurality of predetermined chord patterns.

17. A method of automatically correcting a pitch of a musical instrument including a note input device for inputting note input signals according to a first intonation system, in particular, an intonation system with equal temperament and a tone-generating device for receiving the note input signals and for generating respective tones, the method comprising the steps of:

(a) determining whether an input signal pattern, comprising at least two note input signals, corresponds to one of a plurality of predetermined chord patterns each comprising a predetermined fundamental note;

(b) in the case of a correspondence of the input signal pattern to one of the plurality of chord patterns, replacing the corresponding input signal pattern by a corrected input signal pattern, the corrected input signal pattern being determined on a basis of the input signal pattern corrected by first and third correction factors, the first correction factor being attributed to the one chord pattern and being determined to correct, according to a second intonation system, different from the first intonation system, in particular an intonation system with "just" intonation, all note input signals except for a note input signal corresponding to the fundamental note of the respective chord pattern;

(c) determining whether two successive input signal patterns, first and second signal patterns, correspond to two different chord patterns of the plurality of predetermined chord patterns but with at least one coinciding note; and (d) in case of the correspondence of the two successive input patterns to two different chord patterns, further correcting the second input signal pattern over the two successive input patterns by the third correction factor, the third correction factor being determined to shift at least the at least one coinciding note within the second input signal pattern so that a frequency difference between the coinciding notes of the first and the second input signal patterns is less than a pre-determined difference value.

18. A method according to claim 17, wherein said predetermined difference value is 8 cents.

19. A pitch control system for a musical instrument comprising, (i) at least one input device for inputting note input signals according to a first intonation system, in particular, an intonation system with equal temperament; (ii) a tone generating device for receiving the note input signals and for generating respective tones; (iii) a chord recognition circuit for determining whether an input signal pattern comprising at least two note input signals corresponds to one of a plurality of predetermined chord patterns, each of said predetermined chord patterns comprising a predetermined fundamental note; (iv) a correction signal pattern store circuit for storing correcting factors attributed to each of the predetermined chord patterns; (v) a correction circuit for receiving the input signal pattern and the correction signals for generating output signals to be received by the tone-generating device, which output signals correspond to the input signals corrected according to the correction signals; and (vi) a control circuit connected to the chord recognition circuit, the correcting signal pattern store circuit and the correction circuit for causing the correction signal pattern store to deliver the correcting factors attributed to one of said predetermined chord patterns to the correction circuit in case that the chord recognition circuit determines the correspondence of said one chord pattern with the present input signal pattern.

20. A pitch control system according to claim 19, wherein said correction signal pattern store is provided for storing first and second correction factors, the first correction factor being determined to correct, according to a second intonation system, in particular an intonation system with "just" intonation, all note input signals except for that note input signal corresponding to the fundamental note of the respective chord pattern, and said second correction factor being determined to shift all note input signals to one of higher and lower signal values according to whether the first correction factor shifts the note input signals on average to the one of lower and higher signal values, respectively.

21. A pitch control system according to claim 19, further comprising an octave store having 12 storage places attributed to each note of a predetermined 12-tone octave for storing an input signal pattern, with notes of the input signal pattern being projected into the 12-tone octave by 12-tone shifts if laying outside of the predetermined 12-tone octave.

22. A pitch control system according to claim 21, comprising a work store having 12 storage places for receiving a signal content of the octave store, the signal content of the work store being shiftable by one-storage-place steps in a predetermined direction, with a number of shift steps being counted by a shift counter.

23. A pitch control system according to claim 21, comprising a chord pattern store with a plurality of storage lines each provided with 12 storage places, each line being attributed to one of the predetermined chord patterns.

24. A pitch control system according to claim 23, comprising a chord store having 12 storage places attributed to each note of an octave for the storage of a last determined chord.

25. A pitch control system according to claim 23, comprising a correction factor store with storage lines provided each with 12 storage places allocated to each note of an octave, each storage line being attributed to one of the predetermined chord patterns.

26. A pitch control system according to claim 25, comprising an output store with 12 storage places for receiving a content of the storage line attributed to a determined chord within the correction factor store, each storage content being shiftable in on-storage-place steps.

* * * * *